United States Patent [19]

Yamamoto et al.

[11] Patent Number: 4,484,204

[45] Date of Patent: Nov. 20, 1984

[54] HEAT-SENSITIVE RECORD MATERIAL

[75] Inventors: Tohru Yamamoto, Nishinomiya; Hironari Fujioka, Takatsuki, both of Japan

[73] Assignee: Kanzaki Paper Manufacturing Co., Ltd., Tokyo, Japan

[21] Appl. No.: 479,991

[22] Filed: Mar. 29, 1983

[30] Foreign Application Priority Data

Apr. 10, 1982 [JP] Japan ..... 57-60226
Jun. 18, 1982 [JP] Japan ..... 57-105657

[51] Int. Cl.[3] ..... B41M 5/18
[52] U.S. Cl. ..... 346/200; 346/226; 427/150; 427/151; 427/152; 430/942
[58] Field of Search ..... 282/27.5; 346/200, 226; 428/411, 488, 537, 913, 914, 340–342; 427/35, 43.1, 150–153; 430/942

[56] References Cited

U.S. PATENT DOCUMENTS 4,370,370 1/1983 Iwata et al. ..... 428/40
4,388,362 6/1983 Iwata et al. ..... 428/211

FOREIGN PATENT DOCUMENTS 0019840 2/1978 Japan ..... 346/226

*Primary Examiner*—Bruce H. Hess
*Attorney, Agent, or Firm*—Larson and Taylor

[57] ABSTRACT

This invention provides a heat-sensitive record material comprising a base sheet and a heat-sensitive record layer formed over the base sheet and containing a color forming material and a color developing material which undergoes a color forming reaction on contact with the color forming material, the heat-sensitive record material being characterized in that a resin coating layer cured with electron beam is formed over the heat-sensitive record layer; and also a heat-sensitive record material comprising a base sheet and a heat-sensitive record layer formed over the base sheet and containing a color forming material and a color developing material which undergoes a color forming reaction on contact with the color forming material, the heat-sensitive record material being characterized by a resin coating layer cured with electron beam, formed over the heat-sensitive record layer and containing about 5 to about 300 parts by weight of a pigment per 100 parts by weight of the resin.

9 Claims, No Drawings

HEAT-SENSITIVE RECORD MATERIAL

This invention relates to heat-sensitive record materials, and more particularly to heat-sensitive record materials having outstanding image density retentivity.

Heat-sensitive record materials are well known which make use of the color forming reaction of a color forming material with a color developing material which develop a color on contact with the color forming material, such that the two materials are brought into contact with each other by heating to produce a color image. These heat-sensitive record materials are relatively inexpensive, and record devices therefor are compact and relatively easy to maintain. Accordingly such materials are useful as record media for facsimile systems, computers, etc. and are also in wide use for other applications. However, the heat-sensitive record material is generally low in resistance to water, oils and plasticizers and therefore has the drawback that when the color image formed is brought into contact with water, oil or plasticizer contained in plastic film, the image density markedly reduces. The material also has low resistance to organic solvents, so that an organic solvent, when depositing on the heat-sensitive material, causes the undesired development of color.

Although proposals have been made in an attempt to overcome the above drawbacks, the proposed materials are still unsatisfactory in resistance to water, oils, plasticizers and organic solvents. The proposals even entail different drawbacks. For example, according to Unexamined Japanese patent publication No. 128347/1979, it has been proposed to coat a heat-sensitive record layer with an aqueous emulsion of a resin having ability to form a film and resistance to chemicals (hereinafter referred to as "coating method"), or to form the resin into a film and stick the film on a heat-sensitive layer with an adhesive (hereinafter referred to as "resin film sticking method"). However, the coating method has the drawback that the product is liable to wrinkle or curl. Further while there is a need to dry the coating at a higher temperature to achieve an increased coating speed, the drying temperature, if exceedingly high, permits the heat-sensitive record layer to undesirably form color. The coating speed is therefore limited to render the method inefficient to practice. With the resin film sticking method, the use of an organic solvent-containing adhesive results in the undesired formation of color on the heat-sensitive layer, while when the adhesive used is an aqueous emulsion, the undesired color formation also takes place if the emulsifier is a cationic electrolyte, or reduced color-formability results if the emulsifier is a nonionic electrolyte. The resin film sticking method further requires a very cumbersome procedure.

It is also proposed to form a layer of ultraviolet-curing resin over a heat-sensitive record layer (Unexamined Japanese patent publication No. 67293/1981). However, this method requires for curing the resin a considerable amount of benzophenone or like photosensitizer which gives off a strong odor, and the odor remains even in the product. Moreover, the radiant heat from an ultraviolet lamp is likely to produce the undesired color on the heat-sensitive layer. The method has another drawback in that the coating composition for forming the resin layer has a short pot life, whereas the resin requires a long period of time for curing.

An object of the present invention is to provide a heat-sensitive record material having high resistance to water, oils, plasticizers and organic solvents and therefore adapted to produce images having outstanding density retentivity.

Another object of the invention is to provide a heat-sensitive record material which is free of the undesired formation of color on the heat-sensitive layer.

Another object of the invention is to provide a heat-sensitive record material which will not wrinkle or curl.

Still another object of the invention is to provide a heat-sensitive record material which can be commercially produced advantageously without the drawbacks of the prior art, such as a cumbersome process, release of odor and prolonged resin curing time.

The present invention provides a heat-sensitive record material comprising a base sheet and a heat-sensitive record layer formed over the base sheet and containing a color forming material and a color developing material which undergoes a color forming reaction on contact with the color forming material, the heat-sensitive record material being characterized in that a resin coating layer cured with electron beam is formed over the heat-sensitive record layer.

We have carried out intensive research on heat-sensitive record materials which are outstanding in the image density retentivity and found that the foregoing drawbacks of conventional heat-sensitive record materials can be overcome by forming a resin coating layer cured with electron beam over a heat-sensitive record layer, consequently making it possible to commercially very advantageously produce a heat-sensitive record material having high resistance to water, oils, plasticizers and organic solvents. Through further continued research, we have also found that when the resin coating layer cured with electron beam has incorporated therein a specified quantity of a pigment, the reduction of image density, undesired formation of color, etc. can be prevented even under severe conditions involved, for example, when water and plasticizer are brought into contact with the heat-sensitive record material at the same time or when oils or organic solvents are in contact with the record material for a long period of time.

Accordingly the invention also provides a heat-sensitive record material comprising a base sheet and a heat-sensitive record layer formed over the base sheet and containing a color forming material and a color developing material which undergoes a color forming reaction on contact with the color forming material, the heat-sensitive record material being characterized by a resin coating layer cured with electron beam, formed over the heat-sensitive record layer and containing about 5 to about 300 parts by weight of a pigment per 100 parts by weight of the resin.

While the reason why the presence of the pigment in the resin coating layer affords remarkably improved retentivity of image density when water and plasticizer are brought into contact with the heat-sensitive record material at the same time (hereinafter referred to as "resistance to water-plasticizer") and other properties still remains to be clarified, the resin coating layer which is cured with electron beam according to the invention exhibits the outstanding effect although such effects can not be achieved, for example, by admixing pigments with ultraviolet-curing resins, aqueous emulsions of resins or water-soluble resins, such as polyvinyl alcohol. Incidentally, if a pigment is incorporated in an ultraviolet-curing resin, the pigment acts as an ultraviolet absorber and therefore seriously reduces the curing velocity of the resin coating layer. Further if an aqueous resin emulsion or water-soluble resin is used, the coating layer must be dried at a low temperature to avoid the color formation of the record layer. In this case, it is impossible to achieve a barrier effect sufficient for giving high resistance to water, oils, plasticizers, water-plasticizer and organic solvents presumably because the resin component, while being dried, partly penetrates into the record layer to locally expose the pigment.

According to the invention, any of known sheets are usable as base sheets. Typical of such sheets are paper, paper of synthetic fiber, synthetic resin film, etc.

Color forming materials and color developing materials useful for the record layer of the invention are, for example, the combination of a colorless or pale-colored basic dye and an inorganic or organic acidic material, and the combination of ferric stearate of like metallic salt of higher fatty acid and gallic acid or like phenol.

Examples of useful colorless or pale-colored basic dyes are those already known and include:

Triarylmethane-based dyes, e.g., 3,3-bis(p-dimethylaminophenyl)-6-dimethylaminophthalide, 3,3-bis(p-dimethylaminophenyl)phthalide, 3-(p-dimethyl-aminophenyl)-3-(1,2-dimethylindole-3-yl)phthalide, 3-(p-dimethylaminophenyl)-3-(2-methylindole-3-yl)-phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinapthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-β-anilinolactam, rhodamine-(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran,3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)-fluoran, 3-dibutylamino-7-(o-chlorophenylamino)fluoran, 3-pyrrolidino-6-methyl-7-p-butylphenylaminofluoran, etc.

Examples of inorganic or organic acidic materials which undergo a color forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-tert-octylphenol, 4-phenylphenol, 4-acetylphenol, α-naphthol, β-naphthol, hydroquinone, 2,2'-dihydroxydiphenyl, 2,2'-methylenebis-(4-methyl-6-tert-butylphenol), 2,2'-methylenebis-(4-chlorophenol), 4,4'-dihydroxy-diphenylmethane, 4,4'-isopropylidenediphenol, 4,4'-isopropylidenebis(2-tert-butylphenol), 4,4'-sec-butylidenediphenol, 4,4'-cyclohexylidenediphenol, 4,4'-dihydroxydiphenyl sulfide, 4,4'-thiobis(6-tert-butyl-3-methylphenol), 4,4'-dihydroxydiphenyl sulfone, 4-hydroxybenzoic acid benzylester, 4-hydroxyphthalic acid dimethylester, hydroquinone monobenzyl ether, novolak phenol resins and phenolic polymers: aromatic carboxylic acids such as benzoic acid, p-tert-butylbenzoic acid, trichlorobenzoic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)-salicylic acid, 3-chloro-5-(α-methylbenzyl)-salicylic acid, 3,5-di-tert-butylsalicylic acid, 3-phenyl-5-(α,α-dimethylbenzyl)-salicylic acid, 3,5-di-(α-methylbenzyl)-salicylic acid and terephthalic acid: also, salts of such phenolic compounds or aromatic carboxylic acids with polyvalent metals such as zinc, magnesium, aluminum, calcium, titanium, manganese, tin and nickel.

For the preparation of the heat-sensitive record material of the present invention, the proportions of the color forming material and the color developing material to be incorporated into the record layer are suitably determined according to the kinds of these materials and are not particularly limited. For example, when the combination of a colorless or pale-colored basic dye and an inorganic or organic acidic material is used, 1 to 50 parts by weight, preferably 2 to 10 parts by weight, of the acidic material is used per part by weight of the dye.

These materials are formulated into a heat-sensitive coating composition generally with use of water as a dispersion medium and a stirring or pulverizing device, such as a ball mill, attritor or sand mill, by dispersing the two material at the same time or separately. Usually the coating composition has incorporated therein a binder, such as starches, hydroxyethyl cellulose, methyl cellulose, carboxymethyl cellulose, gelation, casein, gum arabic, polyvinyl alcohol, styrenemaleic anhydride copolymer salt, styrene-acrylic acid copolymer salt, styrene-butadiene copolymer emulsion or the like. The binder is used in an amount of about 5 to about 40% by weight, preferably about 10 to about 30% by weight, based on the total solids content of the composition.

Various auxilliary agents can be further admixed with the heat-sensitive coating composition. Examples of useful auxiliary agents are dispersants such as sodium diocytylsulfosuccinate, sodium dodecylbenzenesulfonate, sodium lauryl sulfate and fatty acid metallic salts; ultraviolet absorbers of the benzophenone, triazole or like type; defoaming agents; fluorescent dyes; coloring dyes, etc.

When desired for lowering the melting temperature of the record layer and improving the record sensitivity thereof, a sensitizer can be admixed with the composition in an amount of about 10 to about 1000 parts by weight, preferably about 50 to about 500 parts by weight, per 100 parts by weight of the color developing material. Examples of useful sensitizers are stearic acid amide, stearic acid methylenebisamide, oleic acid amide, palmitic acid amide, sperm oleic acid amide and coconut fatty acid amide.

Further when desired, other additives can be incorporated into the composition. Examples of useful additives are waxes such as stearic acid, polyethylene wax, carnauba wax, paraffin wax, calcium stearate and ester wax, and inorganic pigments such as kaolin, clay, talc, calcium carbonate, calcined clay, titanium oxide, kieselguhr, fine granular anhydrous silica and active clay.

The method of forming the record layer of the heat-sensitive record material of the invention is not particularly limited but can be any of conventional methods. For example, the heat-sensitive coating composition is applied to the base sheet by air knife coating or blade coating and then dried. The amount of the coating composition, which is also not particularly limited, is generally about 2 to about 12 g/m$^2$, preferably about 3 to about 10 g/m$^2$, based on dry weight.

According to the present invention, it is critical that a resin layer cured with electron beam be formed over the record layer thus formed. The resin layer is prepared from a coating composition containing at least one oligomer having at least one ethylenically unsaturated bond in the molecule, by applying the composition to the record layer and curing the coating with electron beam.

The oligomer to be used in the present invention is not particularly limited but can be any of a wide variety of oligomers which are liquid at room temperature, give a uniform smooth uncured resin coating when applied and form a cured resin film when irradiated with electron beam. Such oligomers having at least one ethylenically unsaturated bond generally have a molecular weight of up to about 50,000, but those exceeding 50,000 in molecular weight are also usable insofar as they have the above-mentioned properties. Typical examples of such oligomers are as follows.

(a) Unsaturated polyesters

Condensation products of maleic acid, fumaric acid or like unsaturated dibasic acid, phthalic acid or like saturated dibasic acid, and ethylene glycol or like dihydric alcohol.

(b) Polyester acrylates or polyester methacrylates

Condensation products of phthalic acid, maleic acid, fumaric acid or like dibasic acid, ethylene glycol, glycerin, pentaerythritol or like polyhydric alcohol, and acrylic acid or methacrylic acid.

(c) Urethane acrylates or urethane methacrylates

Condensation products of ethylene glycol or like dihydric alcohol, adipic acid or like dibasic acid, toluenediisocyanate or like diisocyanate, and acrylic acid or methacrylic acid.

(d) Epoxy acrylates or epoxy methacrylates

Reaction products of an epoxy resin (product of epichlorohydrin or the like and a polyhydric phenol) and acrylic acid or methacrylic acid.

(e) Silicone acrylates or silicone methacrylates

Reaction products of an acryloyl (or methacryloyl) alkoxysilane and an organopolysiloxane.

(f) Polybutadiene acrylates or polybutadiene methacrylates

Reaction products of a polybutadiene oligomer, a diisocyanate, and 2-hydroxyethyl acrylate (or methacrylate) or like hydroxyl-containing acrylate (or methacrylate).

(g) Polyether acrylates or polyether methacrylates

Condensation products of acrylic acid or methacrylic acid and an addition product prepared from trimethylolpropane, pentaerythritol or like polyhydric alcohol and alkylene oxide.

(h) Melamine acrylates or melamine methacrylates

Condensation products of methylolmelamine and 2-hydroxyethyl acrylate (or methacrylate) or like hydroxyl-containing acrylate (or methacrylate).

These electron-beam-curing oligomers are used singly, or at least two of them are used in combination. Furthermore, copolymers of at least two of them are usable. When desired, these oligomers can be used in combination with vinyl monomers and/or resins not curable with electron beam insofar as there is no adverse effect on the advantages of the invention. Such vinyl monomers are used for adjusting the viscosity of the coating composition and for promoting three-dimentionsal curing of the resin layer. Examples of useful vinyl monomers are olefinic monomers such as styrene and α-methylstyrene; acrylate monomers such as methyl acrylate, 2-ethylhexyl acrylate, methoxyethyl acrylate, butoxyethyl acrylate, butyl acrylate, methoxybutyl acrylate, cyano acrylate, cyanoethyl acrylate and phenyl acrylate; methacrylate monomers such as methyl methacrylate, propyl methacrylate, methoxyethyl methacrylate, ethoxymethyl methacrylate, phenyl methacrylate, ethyl methacrylate and lauryl methacrylate; acrylamides and methacrylamides such as acrylamide, methacrylamide, N,N-dimethylacrylamide, N,N-diisopropylacrylamide, N,N-didecylacrylamide, N,N-dimethylmethacrylamide and N,N-diethylmethacrylamide; N,N-dialkylaminoalkyl esters of acrylic acid or methacrylic acid such as 2-(N,N-dimethylamino)methyl acrylate, 2-(N,N-dimethylamino)ethyl acrylate, 2-(N,N-dibenzylamino)ethyl acrylate, 2-(N,N-dimethylamino)-methyl methacrylate and 2-(N,N-diethylamino)propyl acrylate; and esters of acrylic acid or methacrylic acid with di- or polyol such as ethylene glycol diacrylate, propylene glycol diacrylate, neopentyl glycol diacrylate, 1,6-hexanediol diacrylate, diethylene glycol diacrylate, triethylene glycol diacrylate, dipropylene glycol diacrylate, ethylene glycol dimethacrylate, propylene glycol dimethacrylate and diethylene glycol dimethacrylate. The resins which are not curable with electron beam are used for adjusting the hardness of the resin layer. Examples of such resins are acrylic resins, silicone resins, alkyd resins, fluorine- containing resins and butyral resins.

According to the present invention a heat-sensitive record material which is outstanding in properties such as resistance to water, oils, plasticizers, organic solvents, etc. can be obtained merely by applying a coating composition containing the resin component only to a record layer and curing the coating with electron beam. As already stated, these properties can be further improved by incorporating a specified quantity of a pigment into the resin layer cured with electron beam. For this purpose, the specified quantity of pigment is admixed with the coating composition containing the resin component, the resulting composition is applied to the record layer, and the coating is cured with electron beam. Examples of useful pigments are generally white or pale-colored pigments including inorganic pigments such as calcium carbonate, zinc oxide, aluminum oxide, titanium dioxide, silicon dioxide, aluminum hydroxide, barium sulfate, zinc sulfate, talc, kaolin, clay, calcined clay and colloidal silica; organic pigments such as styrene microball, nylon powder, polyethylene powder, raw starch particles, zinc stearate, magnesium stearate, calcium stearate and barium stearate, and pigments obtained by surface-treating or coating such pigments with fluorine, silicon, wax, higher fatty acid, organic titanate, silane coupling agent, high-molecular-weight resin compound, organic acid or inorganic acid. Useful pigments are about 0.3 to about 5 μm, preferably about 0.5 to about 3 μm, in particle size. Such pigments are used in an amount of about 5 to about 300 parts by weight, preferably about 10 to about 200 parts by weight, most preferably about 20 to about 100 parts by weight, per 100 parts by weight of the resin component. If the proportion of the pigment is less than 5 parts by weight, remarkably improved resistance to water-plasticizer, oils and organic solvents will not be obtained, whereas when containing more than 300 parts by weight of the pigment, the coating composition is unable to form a satisfactory film.

According to the invention, coloring dyes and coloring pigments can be incorporated into the coating composition for coloring when so desired. Also usable are suitable auxiliary agents, such as defoaming agents, leveling agents, lubricants and surfactants.

According to the present invention, the coating composition consisting essentially of a resin component, or a resin component and a pigment is fully treated with a mixer-agitator, such as a mixer, attritor, ball mill or roll mill and then applied onto a heat-sensitive record layer with a known coater. To maintain the coating composition at a suitable viscosity, the composition may be heated or a solvent may be added thereto if desired, provided that the advantages of the invention can be assured.

Although the amount of the coating composition to be applied is not particularly limited, the desired result can not be achieved fully when the amount is up to about 0.1 g/m$^2$ in terms of the weight of cured coating, whereas if the amount is more than about 20 g/m$^2$, the heat-sensitive record material is likely to have seriously reduced record sensitivity, so that the amount is generally about 0.1 to about 20 g/m$^2$, preferably about 0.5 to about 10 g/m$^2$, calculated as the weight of cured coating.

Electron beam accelerators useful for curing the resin coating layer according to the invention are devices for generating electron beam having energy of 50 to 1000 KeV, preferably 100 to 500 KeV. Examples of useful electron beam accelerators are any of known type such as Cockcroft-Walton type, Van de Graaff type, etc.

The method of applying electron beam is not particularly limited and may be the scanning method or electrocurtain method.

According to the invention, the resin coating layer is irradiated with electron beam at a suitable dose which should be determined according to the kind of the resin component, the formulation and amount of the coating composition to be used. At a dose of less than about 0.1 Mrad, the resin component can not be cured fully, whereas the heat-sensitive record material is likely to undesirably form color at a dose exceeding about 15 Mrad, so that the preferred dose is about 0.1 to about 15 Mrad, more desirably about 0.5 to about 10 Mrad.

Thus the present invention provides a heat-sensitive record material which is free of the drawbacks of the prior art and outstanding in the image density retentivity and which can be produced by an efficient process resorting to a short period of treatment with electron beam.

While this outstanding advantage of the invention is afforded by a resin coating layer formed over a record layer and cured with electron beam, with or without a specified quantity of pigment incorporated in the coating layer, further improved preservability is available by forming such a resin coating layer also on the rear side of the heat-sensitive record material when so desired.

When composed of a plurality of sublayers, the resin coating layer can be made compacter. Further before the formation of the resin coating layer, the record layer can be formed with a resin layer of polyvinyl alcohol, methyl cellulose, hydroxyethyl cellulose, ethylene-acrylic acid copolymer salt, styrene-maleic anhydride copolymer salt, styrene-butadiene latex, acrylic latex, vinyl acetate latex, electron-beam-curing resin or the like.

Like the conventional heat-sensitive record materials, the heat-sensitive record material of the invention thus prepared gives color images when scanned with a record head or hot pen in contact therewith.

The invention will be described below in greater detail with reference to the following examples, to which the invention of course is not limited. In these examples, the parts and percentages are all by weight unless otherwise specified.

EXAMPLE 1

(1) Preparation of mixture A

| (1) Preparation of mixture A | |
|---|---|
| 3-(N—Cyclohexyl-N—methylamino)-6-methyl-7-phenylaminofluoran | 10 parts |
| Methyl cellulose, 5% aqueous solution | 5 parts |
| Water | 30 parts |

The above mixture was pulverized by a sand mill to a mean particle size of 3 μm.

(2) Preparation of mixture B

| (2) Preparation of mixture B | |
|---|---|
| 4,4'-Isopropylidenediphenol | 20 parts |
| Methyl cellulose, 5% aqueous solution | 5 parts |
| Water | 55 parts |

The above mixture was pulverized by a sand mill to a mean particle size of 3 μm.

(3) Formation of record layer

Forty-five parts of the mixture A, 80 parts of the mixture B, 50 parts of 20% aqueous solution of oxidized starch and 10 parts of water were mixed together and agitated to obtain a heat-sensitive coating composition. The composition was applied to non-coated paper (15 cm×20 cm) weighing 50 g/m$^2$ in an amount of 6 g/m$^2$ based on dry weight and then dried to obtain a heat-sensitive record paper.

(4) Formation of resin coating layer

A resin layer coating composition given below was applied onto the record layer of the paper in an amount of 5 g/m$^2$ with a hand coating Mayer bar and irradiated with electron beam at a dose of 3 Mrad by an electron beam applicator of the electrocurtain type (CB-150 Model, product of Energy Sciences INC.) to cure the resin component and obtain a resin-coated heat-sensitive record paper.

| Coating composition | |
|---|---|
| Polyester acrylate oligomers (trademark ARONIX M-6200, product of Toa Gosei Chemical Industry Co., Ltd.) | 70 parts |
| (trademark ARONIX M-8060, product of the same) | 30 parts |

EXAMPLE 2

A resin-coated heat-sensitive record paper was prepared exactly in the same manner as in Example 1 except that the coating composition for the resin layer was applied in an amount of 1.0 g/m$^2$.

EXAMPLE 3

A resin-coated heat-sensitive record paper was prepared in the same manner as in Example 1 except that the resin layer coating composition was applied in an amount of 10 g/m$^2$.

EXAMPLE 4

A resin-coated heat-sensitive record paper was prepared in the same manner as in Example 1 except that electron beam was applied at a dose of 0.5 Mrad.

EXAMPLE 5

A resin-coated heat-sensitive record paper was prepared in the same manner as in Example 1 except that the dose of electron beam was 10 Mrad.

EXAMPLE 6

A resin-coated heat-sensitive record paper was prepared in the same manner as in Example 1 with the exception of using the following resin layer coating composition.

| Coating composition | |
|---|---|
| Polyester acrylate oligomer (trademark ARONIX M-220, product of Toa Gosei Chemical Industry Co., Ltd.) | 30 parts |
| Polyurethane acrylate oligomer (trademark ARONIX M-1100, product of the same) | 60 parts |
| Polyester acrylate oligomer (trademark ARONIX M-8060, product of the same) | 10 parts |

EXAMPLE 7

A resin-coated heat-sensitive paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 30 parts |
| (trademark ARONIX M-6200, product of the same) | 70 parts |
| Calcium carbonate (trademark SOFTON 1200, product of Bihoku Funka Co., Ltd., 1.8 μm | 50 parts |

-continued

| | |
|---|---|
| in mean particle size) | |

EXAMPLE 8

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 30 parts |
| (trademark ARONIX M-6200, product of the same) | 70 parts |
| Calcium carbonate (trademark SOFTON 1200, product of Bihoku Funka Co., Ltd.) | 100 parts |

EXAMPLE 9

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 40 parts |
| (trademark ARONIX M-6200, product of the same) | 60 parts |
| Calcium carbonate (trademark SOFTON 1200, product of Bihoku Funka Co., Ltd.) | 25 parts |

EXAMPLE 10

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 30 parts |
| (trademark ARONIX M-6200, product of the same) | 70 parts |
| Calcium carbonate (trademark SOFTON 1200, product of Bihoku Funka Co., Ltd.) | 180 parts |

EXAMPLE 11

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 35 parts |
| (trademark ARONIX M-6200, product of the same) | 65 parts |
| Calcium carbonate surface-treated with beef tallow | |

-continued

| | |
|---|---|
| (trademark LIGHTON BK, product of Bihoku Funka Co., Ltd., 0.87 μm in mean particle size) | 50 parts |

EXAMPLE 12

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 40 parts |
| (trademark ARONIX M-6200, product of the same) | 60 parts |
| Silicon dioxide (trademark MIZUKASIL, product of Mizusawa Chemical Co., Ltd., about 2 μm in mean particle size) | 25 parts |

EXAMPLE 13

A resin-coated heat-sensitive record paper was prepared in the same manner as in Example 1 with the exception of using the following resin layer coating composition.

| Coating composition | |
|---|---|
| Polyurethane acrylate oligomer (trademark ARONIX M-1100, product of 50 parts Toa Gosei Chemical Industry Co., Ltd.) | |
| Polyester acrylate oligomer (trademark ARONIX M-220, product of the same) | 50 parts |
| Calcium carbonate (trademark SOFTON 1200, product of Bihoku Funka Co., Ltd.) | 70 parts |

EXAMPLE 14

A resin-coated heat-sensitive record paper was prepared in the same manner as in Example 1 with the exception of using the following resin layer coating composition.

| Coating composition | |
|---|---|
| Polyester acrylate oligomer (trademark UVCOAT G, product of Nippon Paint Co., Ltd.) | 100 parts |
| Calcium carbonate (trademark SOFTON 1200, product of Bihoku Funka Co., Ltd.) | 60 parts |

EXAMPLE 15

A resin-coated heat-sensitive record paper was prepared in the same manner as in Example 1 with the exception of using teh following resin layer coating composition.

| Coating composition | |
|---|---|
| Polyester acrylate oligomers (trademark ARONIX M-8060, product of Toa Gosei Chemical Industry Co., Ltd.) | 35 parts |

-continued

| | |
|---|---|
| (trademark ARONIX M-6200, product of the same) | 65 parts |
| Aluminum hydroxide (trademark HIGILITE H-42, product of Showa Denko K.K., about 1.5 μm in mean particle size) | 50 parts |

EXAMPLE 16

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 35 parts |
| (trademark ARONIX M-6200, product of the same) | 65 parts |
| Kaolin (trademark UW-90, product of Engelhard Minerals & Chemicals Corp., 0.6 μm in mean particle size) | 50 parts |

EXAMPLE 17

A resin-coated heat-sensitive record paper was prepared in the same manner as in Example 1 with the exception os using the following resin layer coating composition.

| Coating composition | |
|---|---|
| Epoxy acrylate oligomer (trademark PHOTOMER 3082, product of Diamond Shamrock Corp.) | 55 parts |
| Polyester acrylate oligomer (trademark ARONIX M-220, product of Toa Gosei Chemical Industry Co., Ltd.) | 45 parts |
| Calcium carbonate (trademark SOFTON 1200, product of Bihoku Funka Co., Ltd.) | 50 parts |

EXAMPLE 18

A resin-coated heat-sensitive paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 30 parts |
| (trademark ARONIX M-6200, product of the same) | 70 parts |
| Calcium carbonate (trademark BF-100, product of Bihoku Funka Co., Ltd., 3.6 μm in mean particle size) | 50 parts |

EXAMPLE 19

| | |
|---|---|
| (1) Preparation of mixture A | |
| 3-(N—Ethyl-p-toluidino)-6-methyl-7-phenylaminofluoran | 10 parts |
| Methyl cellulose, 5% aqueous solution | 5 parts |

-continued

| | |
|---|---|
| Water | 30 parts |

The above mixture was pulverized by a sand mill to a mean particle size of 3 μm.

| | |
|---|---|
| (2) Preparation of mixture B | |
| 4,4'-Isopropylidenediphenol | 20 parts |
| Methyl cellulose, 5% aqueous solution | 5 parts |
| Water | 55 parts |

The above mixture was pulverized by a sand mill to a mean particle size of 3 μm.

(3) Formation of record layer

Forty-five parts of the mixture A, 80 parts of the mixture B, 50 parts of 20% aqueous solution of oxidized starch and 10 parts of water were mixed together and agitated to obtain a heat-sensitive coating composition. The composition was applied to non-coated paper (15 cm×20 cm) weighing 50 g/m$^2$ in an amount of 6 g/m$^2$ based on dry weight and then dried to obtain a heat-sensitive record paper.

(4) Formation of resin coating layer

A resin layer coating composition given below was applied onto the record layer of the paper in an amount of 5 g/m$^2$ with a hand coating Mayer bar and irradiated with electron beam at a dose of 3 Mrad by an electron beam applicator of the electrocurtain type (CB-150 Model, product of Energy Sciences INC.) to cure the resin component and obtain a resin-coated heat-sensitive record paper.

| | |
|---|---|
| Coating composition | |
| Polyester acrylate oligomer (trademark ARONIX M-8060, product of Toa Gosei Chemical Industry Co., Ltd.) | 35 parts |
| (trademark ARONIX M-6200, product of the same) | 65 parts |
| Calcium carbonate (trademark SOFTON 1200, product of Bihoku Funka Co., Ltd.) | 50 parts |

COMPARISON EXAMPLE 1

A heat-sensitive record paper was prepared in the same manner as in Example 1 except that the coating composition composed of polyester acrylate oligomers in mixture was not applied.

COMPARISON EXAMPLE 2

A resin-coated heat-sensitive record paper was prepared in the same manner as in Example 1 with the exception of applying the coating composition composed of polyester acrylate oligomers in mixture in an amount of 0.05 g/m$^2$.

COMPARISON EXAMPLE 3

A resin-coated heat-sensitive record paper was prepared in the same manner as in Example 1 except that the coating composition composed of polyester acrylate oligomers in mixture was applied in an amount of 25 g/m$^2$.

COMPARISON EXAMPLE 4

A resin-coated heat-sensitive record paper was prepared in the same manner as in Example 1 except that electron beam was applied at a dose of 0.05 Mrad.

COMPARISON EXAMPLE 5

A resin-coated heat-sensitive record paper was prepared in the same manner as in Example 1 except that the dose of electron beam was 20 Mrad.

COMPARISON EXAMPLE 6

A resin-coated heat-sensitive record paper was prepared by coating the record layer of a heat-sensitive record paper prepared in the same manner as in Example 1 with 5 g/m$^2$ of a photosensitizer-containing acrylate oligomer (trademark UVCOAT 50P-326, product of Nippon Paint Co., Ltd.) serving as an ultraviolet-curing resin and thereafter irradiating the coating with ultraviolet rays for 10 seconds with use of an 80-W high-pressure mercury lamp.

COMPARISON EXAMPLE 7

A resin-coated heat-sensitive record paper was prepared by coating the record layer of a heat-sensitive record paper produced in the same manner as in Example 1 with 5 g/m$^2$, calculated as dry weight, of a resin composition of 50 parts by weight (calculated as solids) of diisobutylene-maleic anhydride copolymer salt (trademark AQUASTAR HR-303-20, product of Hitachi Chemical Co., Ltd.) and 50 parts by weight (calculated as solids) of ethyleneacrylic acid copolymer salt (trademark ZAIKTHENE, product of Seitetsu Kagaku Co., Ltd.) and then drying the coating.

COMPARISON EXAMPLE 8

A resin-coated heat-sensitive record paper was prepared in the same manner as in Example 1 with the exception of using the following resin layer coating composition.

| | |
|---|---|
| Coating composition | |
| Polyester acrylate oligomer (trademark ARONIX M-8060, product of Toa Gosei Chemical Industry Co., Ltd.) | 25 parts |
| (trademark ARONIX M-220, product of the same) | 75 parts |
| Calcium carbonate (trademark SOFTON 1200, product of Bihoku Funka Co., Ltd.) | 400 parts |

COMPARISON EXAMPLE 9

A resin-coated heat-sensitive record paper was prepared by coating the record layer of a heat-sensitive record paper produced in the same manner as in Example 1 with 5 g/m$^2$, calculated as dry weight, of a resin composition of 50 parts (calculated as solids) of diisobutylene-maleic anhydride copolymer salt (trademark AQUASTAR HR-303-20, product of Hitachi Chemical Co., Ltd.), 50 parts (calculated as solids) of ethyleneacrylic acid copolymer salt (trademark ZAIKTHENE, product of Seitetsu Kagaku Co., Ltd.) and 25 parts of calcium carbonate (trademark SOFTON 1200, product of Bihoku Funka Co., Ltd.) and drying the coating.

COMPARISON EXAMPLE 10

A resin-coated heat-sensitive record paper was prepared in the same manner as in Example 1 with the exception of using the following resin layer coating composition.

| Coating composition | |
|---|---|
| Polyester acrylate oligomers (trademark ARONIX M-8060, product of Toa Gosei Chemical Industry Co., Ltd.) | 35 parts |
| (trademark ARONIX M-6200, product of the same) | 65 parts |
| Calcium carbonate (trademark BF-300, product of Bihoku Funka Co., Ltd., 8.0 μm in mean particle size) | 50 parts |

The 29 kinds of heat-sensitive record papers thus prepared were caused to form color images thereon with use of a constant-temperature heating tester (product of Tokyo Seiki Co., Ltd., conditions: 130°C., 2 kg/cm$^2$, 10 seconds), and the initial image density of each paper was measured by a Macbeth densitometer (Model RD-100R, product of Macbeth Corp., with use of amber filter). Further, background density (color density of non-image area) of each paper was measured in the same manner by Macbeth densitometer. Table 1 shows the result. The papers were further tested for resistance to water, oil, plasticizer, water-plasticizer and organic solvent by the method stated below, and the image density of each paper was thereafter measured by the Macbeth densitometer. The result is shown also in Table 1.

(1) Water resitance: The paper with color images was immersed in water for 5 minutes and thereafter rubbed with gauze to-and-fro by 5 strokes. The image density was then measured.

(2) Oil resistance: Several drops of soybean oil for food were placed onto the image area, the oil was wiped off with gauze 24 hours thereafter, and the image density wa then measured.

(3) Plasticizer resistance: A vinyl chloride lap film (product of Mitsui Toatsu Chemicals, Inc.) was wound around a polypropylene pipe (40 mm in diameter) in three layers, the paper bearing color images was placed over the winding with the image side out, and the film was further wound around the paper in five layers. The image density was measured 72 hours thereafter.

(4) Water-plasticizer resistance: The same film as used above was wound around the same pipe as above in three layers, the paper bearing color images and immersed in water for 5 seconds was placed over the winding with the image side out, and the same film was further wound around the paper in five layers. The image density was measured 24 hours thereafter.

(5) Organic solvent resistance: Several drops of methyl ethyl ketone were placed onto the background area, and the color density of the background area was measured 30 minutes thereafter.

TABLE 1

| | Initial image density | Back ground density | Resistance: Water Density | Water (%)* | Oil Density | Oil (%)* | Plasticizer Density | Plasticizer (%)* | Water-plasticizer Density | Water-plasticizer (%)* | Organic solvent Density | Resin layer curing time (sec) |
|---|---|---|---|---|---|---|---|---|---|---|---|---|
| Ex. 1 | 1.40 | 0.08 | 1.39 | 99 | 1.19 | 85 | 1.26 | 90 | 1.09 | 78 | 0.22 | 0.5 |
| Ex. 2 | 1.50 | 0.08 | 1.46 | 97 | 1.19 | 79 | 1.31 | 87 | 1.15 | 77 | 0.28 | 0.5 |
| Ex. 3 | 1.31 | 0.09 | 1.31 | 100 | 1.19 | 91 | 1.15 | 88 | 0.99 | 76 | 0.29 | 0.5 |
| Ex. 4 | 1.41 | 0.08 | 1.37 | 97 | 1.16 | 82 | 1.23 | 87 | 1.06 | 75 | 0.22 | 0.3 |
| Ex. 5 | 1.48 | 0.13 | 1.48 | 100 | 1.23 | 83 | 1.32 | 89 | 1.29 | 87 | 0.26 | 1.7 |
| Ex. 6 | 1.39 | 0.10 | 1.39 | 100 | 1.11 | 80 | 1.22 | 88 | 1.10 | 79 | 0.21 | 0.5 |
| Ex. 7 | 1.46 | 0.08 | 1.44 | 99 | 1.45 | 99 | 1.43 | 98 | 1.41 | 97 | 0.10 | 0.5 |
| Ex. 8 | 1.40 | 0.08 | 1.38 | 99 | 1.40 | 100 | 1.36 | 97 | 1.34 | 96 | 0.09 | 0.5 |
| Ex. 9 | 1.51 | 0.09 | 1.51 | 100 | 1.48 | 98 | 1.44 | 95 | 1.40 | 93 | 0.10 | 0.5 |
| Ex. 10 | 1.41 | 0.09 | 1.41 | 100 | 1.27 | 90 | 1.27 | 90 | 1.13 | 80 | 0.23 | 0.5 |
| Ex. 11 | 1.43 | 0.08 | 1.40 | 98 | 1.39 | 97 | 1.37 | 96 | 1.35 | 94 | 0.09 | 0.5 |
| Ex. 12 | 1.48 | 0.08 | 1.48 | 100 | 1.45 | 98 | 1.40 | 95 | 1.35 | 91 | 0.10 | 0.5 |
| Ex. 13 | 1.46 | 0.07 | 1.45 | 99 | 1.43 | 98 | 1.41 | 97 | 1.29 | 88 | 0.09 | 0.5 |
| Ex. 14 | 1.50 | 0.08 | 1.48 | 99 | 1.48 | 99 | 1.44 | 96 | 1.40 | 93 | 0.10 | 0.5 |
| Ex. 15 | 1.46 | 0.08 | 1.46 | 100 | 1.43 | 98 | 1.40 | 96 | 1.31 | 90 | 0.11 | 0.5 |
| Ex. 16 | 1.45 | 0.07 | 1.44 | 99 | 1.40 | 97 | 1.39 | 96 | 1.38 | 95 | 0.14 | 0.5 |
| Ex. 17 | 1.43 | 0.07 | 1.43 | 100 | 1.40 | 98 | 1.41 | 99 | 1.40 | 98 | 0.13 | 0.5 |
| Ex. 18 | 1.46 | 0.08 | 1.44 | 99 | 1.40 | 96 | 1.32 | 90 | 1.16 | 79 | 0.25 | 0.5 |
| Ex. 19 | 1.45 | 0.09 | 1.45 | 100 | 1.42 | 98 | 1.38 | 95 | 1.39 | 96 | 0.15 | 0.5 |
| Comp. Ex. 1 | 1.48 | 0.09 | 0.80 | 54 | 0.30 | 20 | 0.31 | 21 | 0.21 | 14 | 1.26 | — |
| Comp. Ex. 2 | 1.50 | 0.10 | 1.01 | 67 | 0.51 | 34 | 0.54 | 36 | 0.39 | 26 | 1.00 | 0.5 |
| Comp. Ex. 3 | 0.68 | 0.14 | 0.60 | 88 | 0.28 | 41 | 0.63 | 93 | 0.60 | 88 | 0.09 | 0.5 |
| Comp. Ex. 4 | 0.75 | 0.12 | 0.60 | 80 | 0.48 | 64 | 0.45 | 60 | 0.39 | 52 | 0.14 | 0.1 |
| Comp. Ex. 5 | 1.49 | 0.89 | 1.50 | 101 | 1.46 | 98 | 1.48 | 99 | 1.30 | 87 | 0.89 | 2.5 |
| Comp. Ex. 6 | 1.15 | 0.20 | 1.13 | 98 | 1.04 | 90 | 1.08 | 94 | 0.76 | 66 | 0.35 | 10 |
| Comp. Ex. 7 | 1.41 | 0.09 | 0.95 | 67 | 1.00 | 71 | 0.76 | 54 | 0.69 | 49 | 1.20 | 60 |
| Comp. Ex. 8 | 1.40 | 0.09 | 1.34 | 96 | 1.05 | 75 | 0.98 | 70 | 0.91 | 65 | 0.63 | 0.5 |
| Comp. Ex. 9 | 1.36 | 0.08 | 1.03 | 76 | 0.86 | 63 | 0.68 | 50 | 0.58 | 43 | 1.23 | 60 |
| Comp. | 1.46 | 0.09 | 1.44 | 99 | 1.20 | 82 | 1.18 | 81 | 0.80 | 55 | 0.70 | 0.5 |

TABLE 1-continued

| | Initial image density | Back ground density | Resistance | | | | | Resin layer curing time (sec) |
|---|---|---|---|---|---|---|---|---|
| | | | Water Density (%)* | Oil Density (%)* | Plasticizer Density (%)* | Water-plasticizer Density (%)* | Organic solvent Density | |
| Ex. 10 | | | | | | | | |

*Image density retentivity

With reference to Table 1, the heat-sensitive record paper is usable free of trouble when having the following properties.

| | |
|---|---|
| Initial image density: | At least 1.20 |
| Background density: | Up to 0.20 |
| Organic solvent resistance: | Up to 0.40 in density |
| Image density retentivity (in connection with resistance to water, oil, plasticizer and water-plasticizer): | At least 70% |

Image density retentivity (%) =

$$\frac{\text{Image density after treatment}}{\text{Initial image density}} \times 100$$

The heat-sensitive record papers obtained in Examples 1 to 19 had no wrinkle, curl or the like. These papers were produced without encountering any particular problem during the preparation procedure. On the other hand, Comparison Example 6 involved the problem of releasing a strong odor, while in Comparison Examples 7 and 9, it was impossible to dry the coating at a high temperature since high temperatures cause the undesired color formation, hence the problem of low operation efficiency.

Table 1 shows that the present invention commercially advantageously affords heat-sensitive record materials having outstanding image preservability.

We claim:

1. A heat-sensitive record material comprising a base sheet and a heat-sensitive record layer formed over the base sheet and containing a color forming material and a color developing material which undergoes a color forming reaction on contact with the color forming material, the heat-sensitive record material being characterized in that a resin coating layer cured with electron beam is formed over the heat-sensitive record layer by applying a coating composition to the record layer and curing the coating with electron beam, the coating composition comprising at least one oligomer liquid at room temperature, capable of giving a uniform smooth uncured resin coating when applied and forming a cured resin film when irradiated with electron beam, and having at least one ethylenically unsaturated bond in the molecule.

2. A heat-sensitive record material as defined in claim 1 wherein the coating composition is applied in an amount of about 0.1 to about 20 g/m$^2$ calculated as the weight of cured coating.

3. A heat-sensitive record material as defined in claim 1 wherein the coating is irradiated with electron.

4. A heat-sensitive record material as defined in claim 1 wherein a resin coating layer cured with electron beam is formed also over the rear surface of the base sheet by applying a coating composition to the record layer and curing the coating with electron beam, the coating composition comprising at least one oligomer liquid at room temperature, capable of giving a uniform smooth uncured resin coating when applied and forming a cured resin film when irradiated with electron beam, and having at least one ethylenically unsaturated bond in the molecule.

5. A heat-sensitive record material comprising a base sheet and a heat-sensitive record layer formed over the base sheet and containing a color forming material and a color developing material which undergoes a color forming reaction on contact with the color forming material, the heat-sensitive record material being characterized by a resin coating layer cured with electron beam, formed over the heat-sensitive record layer and containing about 5 to about 300 parts by weight of a pigment per 100 parts by weight of the resin is formed by applying a coating composition to the record layer and curing the coating with electron beam, the coating composition comprising (a) at least one oligomer liquid at room temperature, capable of giving a uniform smooth uncured resin coating when applied and forming a cured resin film when irradiated with electron beam, and having at least one ethylenically unsaturated bond in the molecule, and (b) the pigment in an amount of about 5 to about 300 parts by weight per 100 parts by weight of the resin.

6. A heat-sensitive record material as defined in claim 5 wherein the coating composition is applied in an amount of about 0.1 to about 20 g/m$^2$ calculated as the weight of cured coating.

7. A heat-sensitive record material as defined in claim 5 wherein the coating is irradiated with electron beam at a dose of about 0.1 to about 15 Mrad.

8. A heat-sensitive record material as defined in claim 5 wherein a resin coating layer cured with electron beam is formed also over the rear surface of the base sheet by applying a coating composition to the record layer and curing the coating with electron beam, the coating composition comprising at least one oligomer liquid at room temperature, capable of giving a uniform smooth uncured resin coating when applied and forming a cured resin film when irradiated with electron beam, and having at least one ethylenically unsaturated bond in the molecule.

9. A heat-sensitive record material as defined in claim 8 wherein the resin coating layer on the rear surface of the base sheet contains a pigment in an amount of about 5 to about 300 parts by weight per 100 parts by weight of the resin.

* * * * *